US007750890B2

(12) United States Patent
Fitzgibbon et al.

(10) Patent No.: US 7,750,890 B2
(45) Date of Patent: Jul. 6, 2010

(54) MOVABLE BARRIER OPERATOR SYSTEM DISPLAY METHOD AND APPARATUS

(75) Inventors: James J. Fitzgibbon, Batavia, IL (US); Robert Daniel-Wayman, Lombard, IL (US); Eric Gregori, Lindenhurst, IL (US); Robert J. Olmsted, Wood Dale, IL (US); Eric J. Robb, Bolingbrook, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 1131 days.

(21) Appl. No.: 10/843,222

(22) Filed: May 11, 2004

(65) Prior Publication Data

US 2005/0253731 A1 Nov. 17, 2005

(51) Int. Cl.
*G39G 5/00* (2006.01)

(52) U.S. Cl. ..... 345/169; 49/199; 340/5.71

(58) Field of Classification Search ..... 345/1.1–3.4, 345/204, 156–158, 169, 159; 340/5.61, 5.71, 340/545.1, 545.6; 29/197, 199; 49/197, 49/199; 318/266, 280–283, 466
See application file for complete search history.

(56) References Cited

U.S. PATENT DOCUMENTS 4,408,251 A * 10/1983 Kaplan ..... 340/543
4,520,576 A 6/1985 Molen
4,821,027 A 4/1989 Mallory et al.
5,429,399 A * 7/1995 Geringer et al. ..... 292/92
5,565,843 A 10/1996 Meyvis
5,630,017 A * 5/1997 Gasper et al. ..... 704/276
5,680,134 A 10/1997 Tsui
5,841,390 A 11/1998 Tsui
5,986,561 A 11/1999 Kuruvilla et al.
6,005,508 A 12/1999 Tsui
6,051,947 A * 4/2000 Lhotak et al.
6,064,303 A 5/2000 Klein et al.
6,104,334 A * 8/2000 Allport ..... 345/169
6,111,374 A * 8/2000 Fitzgibbon et al.
6,184,787 B1 2/2001 Morris (Continued)

FOREIGN PATENT DOCUMENTS

CN 1404032 3/2003

(Continued)

OTHER PUBLICATIONS http://www.electronicproductonline.com/catalog/product_info.php?cPath=31_40&product...; Electronic Product Online—Ademco 5804BDV-CN Wireless 4 Button Key Fob with Voice Feedback; Apr. 28, 2004.

(Continued)

*Primary Examiner*—Regina Liang
(74) *Attorney, Agent, or Firm*—Fitch Even Tabin & Flannery

(57) ABSTRACT

A movable barrier operator system operational component includes an integral display comprising at least one of a numeric display, an alphanumeric display, and a graphics display. The display can comprise an active display or an active interactive display and can further operate in conjunction with adjacent user-input interface opportunities. So configured, numerous user interface events can be highly leveraged to contribute to ease of installation and ease and reliability of use.

65 Claims, 4 Drawing Sheets

U.S. PATENT DOCUMENTS

| | | | | |
|---|---|---|---|---|
| 6,344,817 | B1 | 2/2002 | Verzulli | |
| 6,397,186 | B1 | 5/2002 | Bush et al. | |
| 6,519,049 | B1 * | 2/2003 | Nagasaka | 358/1.15 |
| 6,650,248 | B1 | 11/2003 | O'Donnell et al. | |
| 6,661,340 | B1 | 12/2003 | Saylor et al. | |
| 7,013,355 | B2 * | 3/2006 | Chambers | |
| 7,111,788 | B2 * | 9/2006 | Reponen | 345/169 |
| 7,123,128 | B2 * | 10/2006 | Mullet et al. | 340/5.71 |
| 7,181,203 | B2 | 2/2007 | Gregori | |
| 7,194,412 | B2 | 3/2007 | Mays | |
| 7,207,142 | B2 * | 4/2007 | Mullet | 49/199 |
| 2002/0135461 | A1 | 9/2002 | Nuesser et al. | |
| 2003/0018478 | A1 | 1/2003 | Mays | |
| 2003/0028380 | A1 | 2/2003 | Freeland et al. | |
| 2003/0034898 | A1 * | 2/2003 | Shamoon et al. | |
| 2005/0151622 | A1 * | 7/2005 | McMahon | 340/5.61 |
| 2005/0176400 | A1 * | 8/2005 | Mullet et al. | |
| 2006/0158344 | A1 * | 7/2006 | Bambini et al. | 340/5.71 |

FOREIGN PATENT DOCUMENTS

| | | | |
|---|---|---|---|
| EP | 1 280 109 | A1 | 1/2003 |
| EP | 1 349 146 | A1 | 10/2003 |
| FR | 2 726 955 | | 5/1996 |
| GB | 2 402 431 | A | 12/2004 |
| GB | 2 402 434 | A | 12/2004 |
| GB | 2 408 063 | A | 5/2005 |
| WO | WO 94/28675 | | 12/1994 |
| WO | WO 01/47130 | | 6/2001 |

OTHER PUBLICATIONS

British Search Report Under Section 17 relating to GB0509537.7 dated Sep. 21, 2005.

* cited by examiner

Appendix A

MOVABLE BARRIER OPERATOR SYSTEM DISPLAY METHOD AND APPARATUS

FIELD OF THE INVENTION

This invention relates generally to movable barrier operator systems.

BACKGROUND OF THE INVENTION

Movable barrier operator systems of various kinds are known in the art. In general, such systems serve to effect selective movement of a movable barrier (including but not limited to garage doors of various kinds, rolling shutters, and other horizontally or vertically sliding, moving, or pivoting doors, gates, arms, and the like) between at least a first position and a second position (such as between an opened and a closed position). Many such systems include at least one and frequently a plurality of movable barrier operator system operational components. Such components serve in general to instigate active operation of the system in general and often (but not always) more specifically the active operation of the movable barrier itself. Examples of such operational components include but are not limited to movable barrier operators and movable barrier operator remote control devices (including wired and wireless remote control devices and portable and stationary remote control devices).

The operational strategies, component configuration and deployment, and feature sets of such systems continues to grow in complexity. At the same time, however, many users are unable or unwilling to make effective use of a challenging user interface. As a result, many modern movable barrier operator systems that support a variety of functions and operational states nevertheless offer only a very limited user interface. For example, only a very few buttons or knobs may be presented in a given prior art system. While such design structures do, in at least some sense, often succeed in maintaining potential user cognitive loading at or below some desired level, these same user interface conditions also potentially unduly constrain the breadth and/or depth of system functionality and capability. This, in turn, can ultimately lead to reduced user satisfaction.

BRIEF DESCRIPTION OF THE DRAWINGS

The above needs are at least partially met through provision of the movable barrier operator system display method and apparatus described in the following detailed description, particularly when studied in conjunction with the drawings, wherein.

Skilled artisans will appreciate that elements in the figures are illustrated for simplicity and clarity and have not necessarily been drawn to scale. For example, the scale as is suggested for some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION OF THE INVENTION

Generally speaking, pursuant to these various embodiments, a movable barrier operator system operational component, such as a movable barrier operator and/or a movable barrier operator remote control device, further comprises an integral display. In some embodiments this display comprises at least one of an alphanumeric display and a graphics display. By at least one approach the movable barrier operator system operational component comprises a movable barrier operator system wall-mounted user-input interface and the display comprises at least a numeric, and preferably at least an alphanumeric, display.

In some embodiments the display can itself comprise a user-input interface (as when the display comprises, in whole or in part, a touch screen display surface). In addition, or in lieu thereof, such a display can be used in close conjunction with one or more user-assertable control surfaces (such as but not limited to push buttons and other switches). Such user-assertable control surfaces can comprise a fixed-function user-assertable control surface or a programmable function user-assertable control surface. It is also possible to configure such an operational component to comprise an audio interface to facilitate, for example, a speech recognition-based interface to thereby receive and process spoken commands or inquiries from a user.

So configured, an operational component having some user input and/or active system control capability and/or responsibility can be further imbued with an ability to provide varying visual content to a user. This, in turn, can facilitate ease of installation or usage, and/or the deployment of a greater number of functional options or capabilities than a present system would typically usefully offer.

Figure 1:
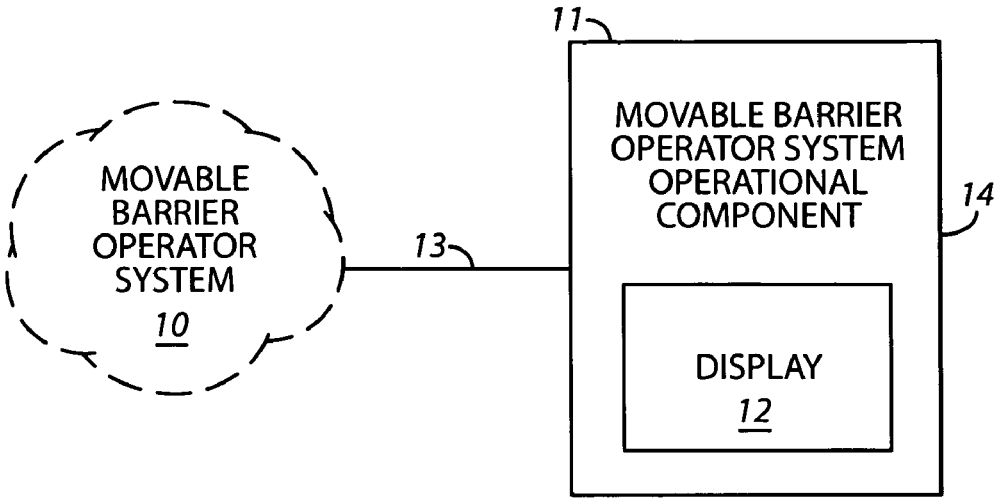
FIG. 1 comprises a block diagram as configured in accordance with various embodiments of the invention.

Referring now to the drawings, and in particular to FIG. 1, an illustrative deployment in conformance with many of these embodiments comprises a movable barrier operator system operational component 11 that operably couples, at least from time to time, via one or more links 13 to a movable barrier operator system 10. (In fact, in many instances, the movable barrier operator system operational component 11 will comprise a part of such a movable barrier operator system 10, but the above parsed illustration serves to aid in delineating certain logical aspects of these embodiments.) The movable barrier operator system 10 can comprise any presently known or hereafter-developed system including, but not limited to, garage door opening systems, gate moving systems, arm guard moving systems, fire door moving systems, and so forth.

The movable barrier operator system operational component 11 comprises a component that provides operational input to such a movable barrier operator system and can include, but is not limited to, a movable barrier operator or a movable barrier operator remote control device. This includes both portable and stationary devices as well as both wired and wireless devices. Wired devices that physically couple to the movable barrier operator system can utilize any appropriate link 13 including but not limited to optical signal paths and electrical signal paths (such as 2-wire conductor bundles as are well known in the art) that support, for example, a 2-wire conductor serial data bus (again as are well known in the art). Wireless devices can utilize any appropriate wireless link 13 including but not limited to infrared-based wireless platforms, radio frequency-based wireless platforms, optical signal-based wireless platforms, and/or sound-based (such as ultrasonic-based) wireless platforms as are generally well understood in the art.

In these embodiments the movable barrier operator system operational component 11 further comprises a display 12. In a preferred approach this display 12 comprises at least one of an alphanumeric display or a graphics display (though in some settings, as when the movable barrier operator system operational component 11 comprises a movable barrier operator system wall-mounted user-input interface, the display 12 can comprise at least a numeric display as versus an alphanumeric display). Also in a preferred approach the movable barrier operator system operational component 11 comprises a housing 14 that houses at least a substantial part of the movable barrier operator system operational component 11 and that at least partially supports the display 12. For example, the display 12 can be substantially retained within the housing 14 or can be partially or fully disposed and retained on an exterior surface of the housing 14.

Such a display 12 can comprise a monochromatic display or a multi-color display (including but not limited to a full-color display) as may best suit the needs of a given application. Any presently known or hereafter-developed display technology can also likely be used as commensurate with the needs of a given setting, including but not limited to scanning-based platforms (such as cathode ray tube-based displays) and pixelated platforms (such as light emitting diode-based displays and liquid crystal displays).

In some embodiments the display 12 may comprise a display-only element. In a preferred approach, however, the display 12 will comprise, at least in part, a touch screen display as is known in the art.

Figure 2:
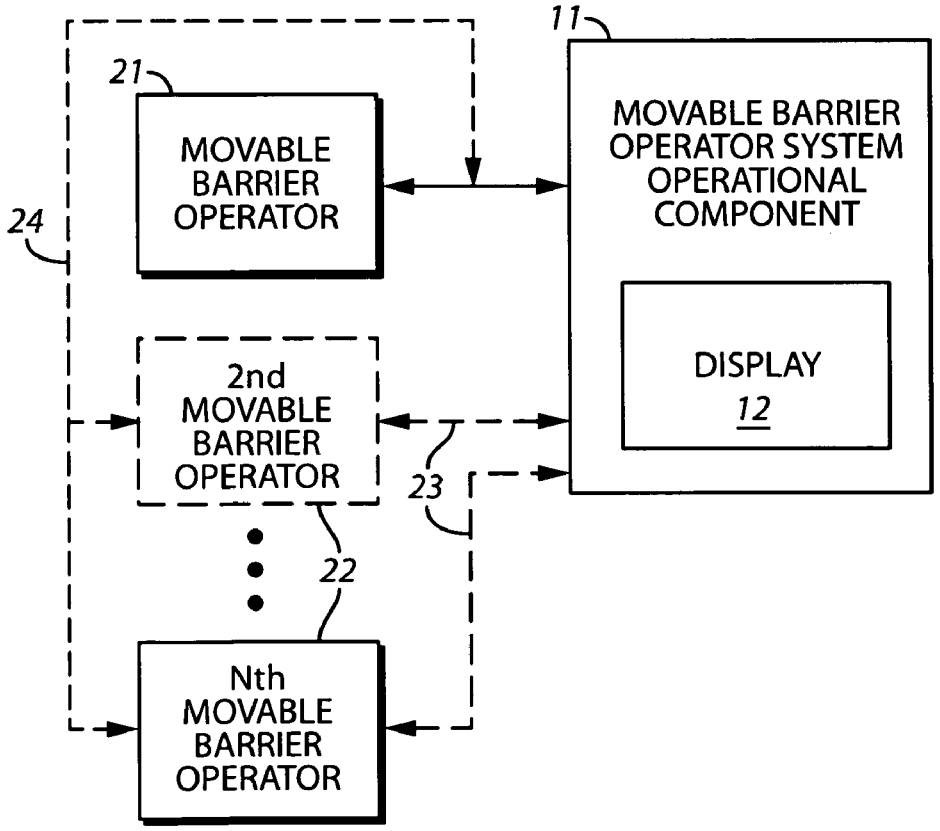
FIG. 2 comprises a block diagram as configured in accordance with various embodiments of the invention.

As already noted above, in many instances the movable barrier operator system operational component 11 will comprise a movable barrier operator system remote control device that couples to a movable barrier operator. With reference to FIG. 2, such a movable barrier operator system remote control device can operably couple to a plurality of movable barrier operators 21 and 22. Such a coupling can be achieved in various ways. For example, a serial bus 24 can be used to achieve this result. As another example, a parallel coupling network 23 can also be used to achieve such a result. In such deployments, the display 12 can be used, for example, to provide information regarding with which of the plurality of movable barrier operators the remote control device is presently communicating or otherwise interacting. As another example, the display 12 can provide a simultaneous display of status information for each such movable barrier operator (such as, but not limited to, status information regarding a present location of each corresponding movable barrier, a present direction of movement for each such corresponding movable barrier, present maximum force setting values for each such corresponding movable barrier, present obstacle detection information for each such corresponding movable barrier, historical movable barrier characteristics, and so forth).

It would also be possible to configure a system having one or more movable barrier operators with a plurality of movable barrier operator system operational components 11, including but not limited to a plurality of remote control devices. For example, a given system might include two wall-mounted remote control devices and three portable wireless remote control devices. Pursuant to these teachings at least one of these remote control devices will comprise an integral display 12. In many application settings, however, it will likely be preferred to include such a display with a larger subset and, in some settings, with each such remote control device.

Substantial advantages can be realized through provision of such a display. It now becomes possible to provide a greater depth of information regarding presently selected or selectable operating features and/or operating parameters and status. This, in turn, makes it considerably easier to provide a richer suite of operating options and features. By providing a display comprising, at least in part, a touch screen display, these benefits are likely leveraged further because user input can be elicited when required (or useful) in a manner that can be far more intuitive and/or guided than is presently attainable with typical standard practices in this field of endeavor.

Figure 3:
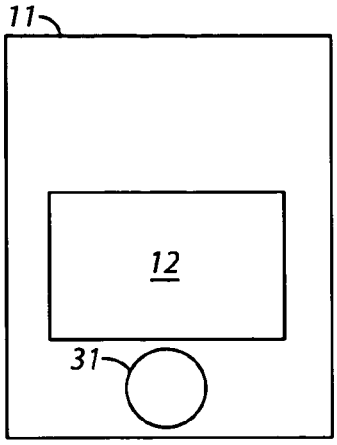
FIG. 3 comprises a schematic representation as configured in accordance with various embodiments of the invention.

Pursuant to some embodiments, and referring now to FIG. 3, the display 12 can be configured in conjunction with at least one discrete and separate user-assertable control surface 31. This control surface 31 can comprise, for example, a push button, a keypad key, a multi-position switch, or the like. In a preferred embodiment this control surface 31 comprises a part of the movable barrier operator system operational component 11. Although such a control surface 31 can be position essentially anywhere on (or in) such a movable barrier operator system operational component 11, in a preferred approach at least one such control surface 31 is disposed proximal to the display 12 itself.

Figure 4:
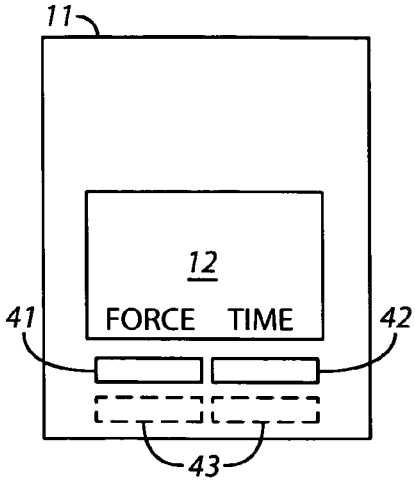
FIG. 4 comprises a schematic representation as configured in accordance with various embodiments of the invention.

When providing a plurality of such control surfaces, and referring now to FIG. 4, some of the control surfaces (such as the control surfaces denoted by reference numerals 41 and 42) can be disposed proximal to the display 12 and some of the control surfaces 43 can be disposed distal to the display 12. If desired, the display 12 can provide information that characterizes in some useful way a corresponding one of the control surfaces. To illustrate this approach, in FIG. 4, a first one of the control surfaces 41 has the word "FORCE" presented proximal thereto on the display 12 while a second one of the control surfaces 42 has the word "TIME" presented proximal thereto on the display 12. This approach communicates a relatively intuitive and self-explanatory message to the user regarding what these two control surfaces 41 and 42 control or otherwise relate to. So configured, a common physical form factor and layout can be used for a variety of different models and/or tiered product offering while nevertheless providing potentially different control surface functionality as between such differing offerings.

Figure 5:
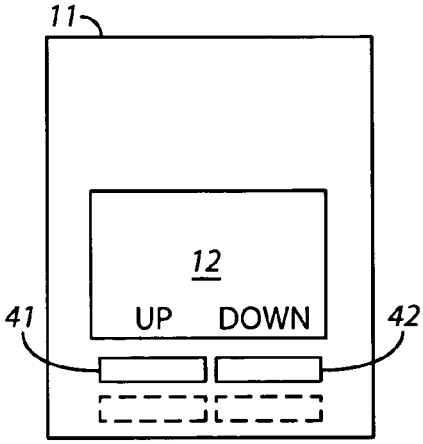
FIG. 5 comprises a schematic representation as configured in accordance with various embodiments of the invention.

It would also be possible to configure one or more such control surfaces as a programmable function user-assertable control surface as versus a fixed-function user-assertable control surface. So configured, the purpose and/or functionality of a given control surface can vary during different modes of operation for a given movable barrier operator system operational component 11. To illustrate, and with continued reference to FIG. 4, a user might select the control surface 41 as then corresponds to the "FORCE" feature (for example, this might refer to a user-defined alteration of an automatically-set maximum force setting as used in an obstacle detection scheme). Upon selecting this "FORCE" feature, the purpose of this particular control surface 41 can then be programmably altered in an appropriate corresponding fashion. To illustrate, and referring now to FIG. 5, this particular control surface 41 can now correspond to an "UP" instruction (while another programmable control surface 42 can now correspond to a "DOWN" instruction). This programmed alteration of the control surface functionality will permit a user to now increase or decrease the FORCE setting without requiring dedication of corresponding buttons or the like. The displayed programmable functionality as corresponds to the altered programmable control surface aids in ensuring that a user will remain properly and easily informed of this revised capability and purpose.

It will therefore be appreciated by those skilled in the art that such a display can significantly impact the flexibility and usability of a given movable barrier operator system operational component 11 and particularly so when the display itself comprises a user entry interface or works in conjunction with other user entry interfaces to facilitate the use and/or programmed alteration of use of such user entry interfaces.

Figure 6:
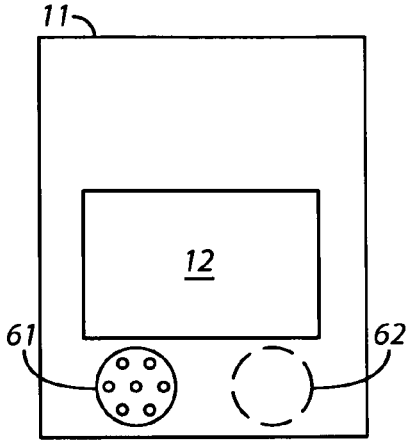
FIG. 6 comprises a schematic representation as configured in accordance with various embodiments of the invention.

In the illustrative examples provided above, a user interacts with the movable barrier operator system operational component 11 via physical contact with the component. It would also be possible to use voice-activated control strategies, either alone or in conjunction with physical-contact based approaches. For example, and referring now to FIG. 6, the movable barrier operator system operational component 11 can include an audio interface such as a microphone 61 to thereby provide a speech recognition-based interface. (Various speech recognition techniques are presently known in the art and more will undoubtedly be developed in the future. These teachings are likely compatible with all such approaches. Since such techniques are well understood in the art, and since these embodiments are not particularly sensitive to the selection of a specific approach, there is no particular need to provide further embellishment or details regarding such speech recognition techniques in this description.) As with the control surfaces described above, the display 12 can provide information that corresponds to use of such an audio input capacity.

As one example, the display can provide options that can be audibly selected. To illustrate, the display could show the following:

| | |
|---|---|
| FORCE | 1 |
| TIME | 2 |
| CODES | 3 |

A user could then audibilize the word "TWO" in order to select the time functionality depicted. In such a case, acceptable speech input is constrained to specific predetermined options. Such an approach typically lends itself well to facilitating speaker independence.

As another example, a user could verbalize the words "TWO POINT THREE" and the display could display the recognized result. By displaying "2.3" the user would receive visual confirmation that the input had been successfully recognized. If "2.8" were displayed instead, the user would quickly understand that the input had been mis-interpreted.

Such examples are intended to be illustrative only and without any intent to comprise an exhaustive selection. Those skilled in the art will recognize that a wide variety of useful interactions between a display and a speech recognition capability in a movable barrier operator system operational component 11 can be envisioned and realized by employing these teachings.

Figure 7:
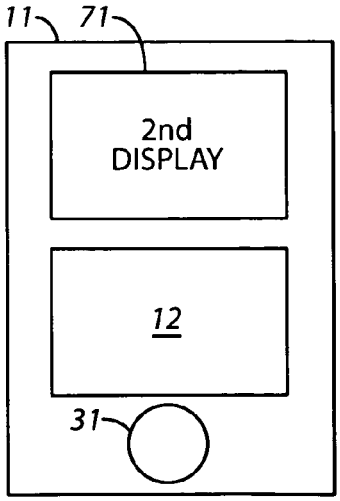
FIG. 7 comprises a schematic representation as configured in accordance with various embodiments of the invention.

In the various embodiments set forth above, the movable barrier operator system operational component 11 had a single display 12. Depending upon the needs of a given application, however, it might be useful or preferred to provide two or more such displays. For example, as illustrated in FIG. 7, a movable barrier operator system operational component 11 can comprise both a first display 12 and a second display 71. Such additional displays can be identical to the first display 12 or different. For example, the first display 12 can comprise a touch screen display and the second display 71 can comprise a non-input form of display. If desired, other differences regarding color, size, presentation technology, resolution, and so forth also be accommodated and served in this way.

Figure 8:
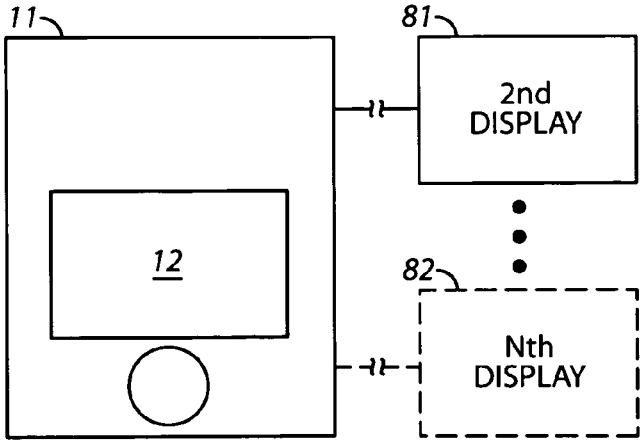
FIG. 8 comprises a schematic representation as configured in accordance with various embodiments of the invention.

In the embodiments described with respect to FIG. 7 the supplemental display(s) comprise a part of the movable barrier operator system operational component 11 itself. If desired, however, and referring now to FIG. 8, a second display 81 can be disposed distal to the movable barrier operator system operational component 11. A remote display 81 could couple in any of many various ways to the movable barrier operator system operational component 11. For example, various wired or wireless signal-bearing pathways could be utilized to support such a deployment. Of course, additional such remote displays 82 could also be accommodated if desired.

Figure 9:
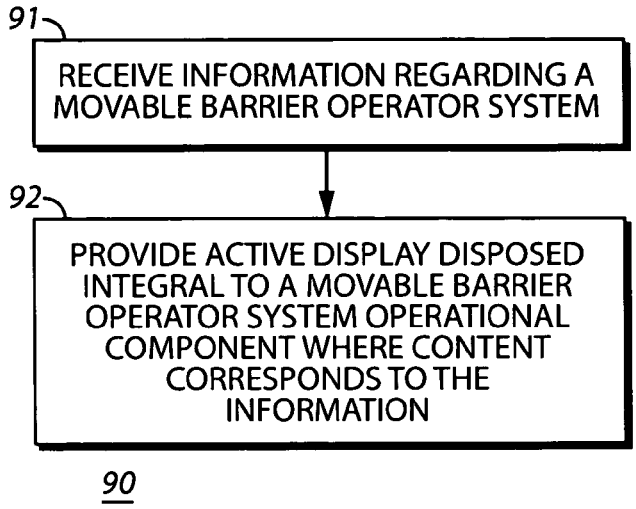
FIG. 9 comprises a flow diagram as configured in accordance with various embodiments of the invention.

If desired, one or more of these display options can be used in conjunction with other output mechanisms as well. For example, an audiblized speech mechanism can be provided to facilitate the provision of audibly articulated informational content to a nearby user. (Synthesized and pre-recorded speech-delivery techniques are known in the art. In addition, further details regarding supporting embodiments and use of speech-delivery mechanisms in a movable barrier operator system are set forth in a patent application entitled MOVABLE BARRIER CONTROL SYSTEM COMPONENT WITH AUDIBLE SPEECH OUTPUT APPARATUS AND METHOD filed on even date herewith, the contents of which are fully incorporated herein by this reference.) When providing such facilities, it will likely often be useful to provide a selection mechanism to permit a user to select which information output approaches to use (alone or in combination with one another) for given corresponding functions and/or periods of time. These various embodiments of a display-bearing movable barrier operator system operational component (and other such enabling platforms as may be selected for use in a given setting) can be used in a variety of ways to support helpful interaction with a system user. For example, and referring now to FIG. 9, one supported process 90 provides for reception 91 of information regarding a movable barrier operator system and the corresponding provision 92 of an active display of content that corresponds, at least in part, to such received information, wherein the active display is disposed integral to a movable barrier operator system operational component and itself comprises at least one of a graphic display and an alphanumeric display.

The received information can comprise any of a wide variety of content including but not limited to:

information from or relating to a movable barrier operator;

information from or relating to obstacle detectors;

information from or relating to a remote control device;

information relating to potential service personal;

information to complement other provided information including, for example, contact information or other commercial messages.

Examples of such information include, but is not limited to:

a fault within the movable barrier operator system;

a decision-making-basis for an automated action;

system status;

status regarding a movable barrier operator system component;

service information;

scheduled maintenance information;

contact information;

commercial content;

information regarding an automatically expiring state; and/or movable barrier operator system help.

Examples of movable barrier operator system help include, but is not limited to:

installation instructions;

set-up instructions;

usage instructions;

configuration information;

maintenance information;

safe-operation information.

As indicated above, such information can be received in a variety of ways including via a wireless communication path and a physical communication path.

Figure 10:
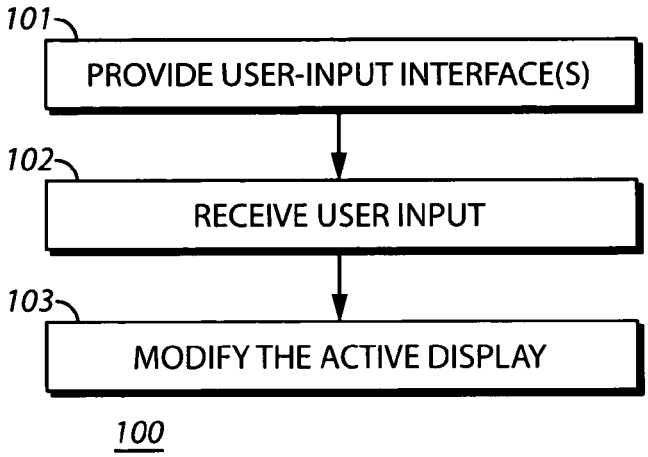
FIG. 10 comprises a flow diagram a configured in accordance with various embodiments of the invention.

Referring now to FIG. 10, the above provision of an active display can further comprise the process 100 of providing an interactive active display of content. This process 100 can comprise, for example, providing 101 at least one user-input interface, receiving 102 user input via the at least one user-input interface, and modifying 103 the active display in response to the user input. As but only two of many possible illustrative examples, the modification of the active display can comprise moving a cursor on the display or presenting new content on the display, which actions correspond, in a preferred approach, to the user's intent as evinced through their interaction with the user-input interface. In general, this interactive process 100 can be used to facilitate such actions or events as (but not limited to):

prompting an installer for information during installation of a movable barrier operator system;

providing an installer with interactive step-by-step instructions during installation or reconfiguration of a movable barrier operator;

confirmed the automated effectation of specific actions during installation of a movable barrier operator;

providing diagnostic information regarding failure or possible-failure conditions and status;

providing fault status information regarding a component or group of components;

providing information regarding a logical condition, state, or sensed condition as prompted a specific action or in-action by the movable barrier operator system;

providing historical information regarding operation, state, faults, detected events or conditions, diagnostic conclusions, and the like;

providing service information regarding, for example, when service is needed (either at present or in the future), servicing instructions, and servicing assistance contact information (such as service company name, service company contact, an Internet address, a street address, a telephone number, and the like for service personnel);

providing information regarding an amount of time consumed and/or an amount of time remaining in an automatically expiring system (or corresponding information for the number of cycles remaining, when cycles rather than time are the relevant measure) (for example, when service personnel has been provided access with a remote control device to facilitate their entry into a given premises); and/or providing commercial content such as advertisements for servicing assistance and materials, system upgrades, additional components and equipment, feature enhancements, and the like.

Figure 11:
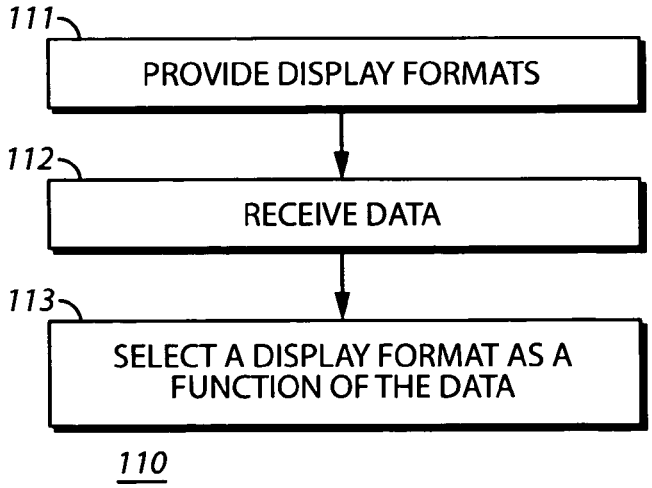
FIG. 11 comprises a flow diagram as configured in accordance with various embodiments of the invention.

To further facilitate these and other content and interactive displays of information, and referring now to FIG. 11, it may also be desirable to provide a process 110 that supports the provision and use of multiple display formats. Such a process 110 can provide 111 a plurality of display formats, and upon receiving 112 data, select 113 a particular one of the plurality of display formats as a function, at least in part, of the data. This selected format can then be applied when providing an active display of content as corresponds, for example, to such (or later) received data.

Such formats can differ with respect to quantity or completeness of information provided (for example, a more complete display of information may be provided to one user as compared to another user), colors utilized and/or graphics applied, location of information on a display, and/or location of live interactive areas on a touch screen display (for example, an activation area for use during a force setting calibration activity may be located relatively high on a wall-mounted user-input interface in order to place that activation area out of the reach of small children), and so forth. The data received can comprise, for example, information regarding an identify of a specific user, to thereby permit selection and use of specific display formats for different users.

Figure 12:
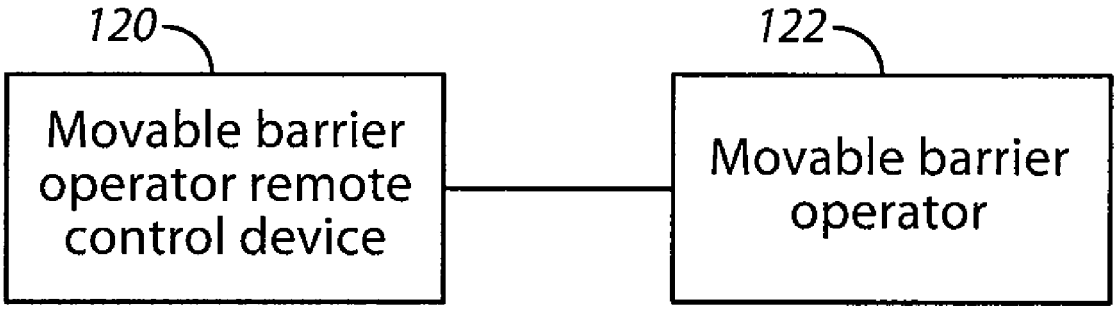
FIG. 12 comprises a block diagram as configured in accordance with various embodiments of the invention.

FIG. 12 illustrates a movable barrier operator remote control device 120 in direct communication with a movable barrier operator 122.

As but one illustrative example of many, when the active display comprises a part of a wall-mounted user-input interface, and when the user is known to be effecting a part of an installation process for the movable barrier operator system, and further when a current part of that installation process requires the user to be located physically proximal to the movable barrier operator instead of the wall-mounted user-input interface, information useful to the user can be displayed using relatively large font sizing in order to permit easier viewing and comprehension of the displayed information by the remotely located user.

In general, the provision of an active display having at least numeric presentation capability when joined in conjunction with a wall-mounted remote user-input interface or at least alphanumeric and/or graphic presentation capability when joined in conjunction with other movable barrier operator system components yields numerous benefits. The resultant ease of communication (both outwardly and in support of interactive communications) can be further leveraged to permit more reliable installation or use of one or more elements of a movable barrier operator system, a greater breadth and depth of operating features and options, and improved security, reliability, and enjoyment of use.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. An apparatus comprising:

a moveable barrier operator which includes a control and a motor;

a movable barrier operator system operational component which is remote from the moveable barrier operator and which component transmits signals to the moveable barrier operator and the moveable barrier operator is configured to receive the signals from the component;

a liquid crystal display that is integral to the movable barrier operator system component, the liquid crystal display selected from the group consisting of an alphanumeric display, a graphics display and combinations thereof; and at least one user-assertable control surface associated with the liquid crystal display and arranged to receive a user input to effect an operational parameter selected from the group consisting of an operating feature, a system setting which configures the operation of the moveable barrier operator and combinations thereof, wherein the at least one control surface is programmed to effect a first operational parameter illustrated on the display upon user interaction at a first time and to effect a second and different operational parameter illustrated on the display upon user interaction at a second time, the user input initiating the signals from the operational component directly to the moveable barrier operator to effect changes in the operational parameters stored in the moveable barrier operator with the user-assertable control.

2. The apparatus of claim 1 wherein the movable barrier operator system operational component comprises a movable barrier operator remote control device.

3. The apparatus of claim 2 wherein the movable barrier operator remote control device is physically coupled to the movable barrier operator.

4. The apparatus of claim 3 wherein the movable barrier operator system operational component is physically coupled to the movable barrier operator by at least one of:

an electrical conductor-based signal path;

an optical-based signal path.

5. The apparatus of claim 1 and further comprising a housing that houses at least a substantial part of the movable barrier operator system operational component and that at least partially supports the display.

6. The apparatus of claim 1 wherein the movable barrier operator system operational component comprises a fixed-position movable barrier remote control device.

7. The apparatus of claim 1 wherein at least a portion of the display comprises a touch-screen display.

8. The apparatus of claim 7 wherein all of the display comprises a touch-screen display.

9. The apparatus of claim 1 wherein the at least one control surface is disposed proximal to the display.

10. The apparatus of claim 9 wherein the at least one user-assertable control surface comprises the programmable function user-assertable control surface.

11. The apparatus of claim 9 and further comprising a plurality of the user-assertable control surfaces.

12. The apparatus of claim 1 wherein the movable barrier operator system operational component further comprises:

at least one fixed-function user-assertable control surface.

13. The apparatus of claim 1 wherein the movable barrier operator system operational component further comprises at least one user-input interface.

14. The apparatus of claim 13 wherein the at least one user-input interface comprises at least one of:

a user-assertable control surface;

an audio interface.

15. The apparatus of claim 14 wherein the audio interface comprises a speech recognition-based interface to receive an audio input from the user.

16. The apparatus of claim 1 and further comprising a second display that is operably coupled to the movable barrier operator system operational component.

17. The apparatus of claim 16 wherein the second display is disposed distal to the movable barrier operator system operational component.

18. The apparatus of claim 1 wherein the display comprises a monochromatic display.

19. The apparatus of claim 1 wherein the display comprises a multi-color display.

20. The apparatus of claim 1 wherein the movable barrier operator system operational component operably couples via-a 2-wire conductor to the movable barrier operator.

21. The apparatus of claim 20 wherein the 2-wire conductor comprises a 2-wire conductor serial data bus to the movable barrier operator.

22. The apparatus of claim 1 wherein the movable barrier operator system operational component operably couples to a plurality of movable barrier operators.

23. The apparatus of claim 22 wherein the movable barrier operator system operational component operably couples via a serial bus to a plurality of movable barrier operators.

24. The apparatus of claim 22 wherein the movable barrier operator system operational component operably couples in parallel to a plurality of movable barrier operators.

25. The apparatus of claim 1 wherein the first operational parameter comprises selecting a system setting to adjust.

26. The apparatus of claim 25 wherein the system setting is at least one selected from the group consisting of:

present maximum force settings;

availability of electrical power;

operational linkage between the movable barrier operator and one or more remote interfaces;

vacation mode settings;

confirmation of calibration actions;

operational status information;

calculated battery life expectancy;

authentication data;

communications statistics; and information regarding the automated movable barrier control system component.

27. A method comprising:

receiving user input to effect an operational parameter stored in a movable barrier operator, the operational parameter being selected from the group consisting of an operating feature, a system setting which configures the operation of the moveable barrier operator and combinations thereof, the user input being received at a user-assertable control surface associated with a moveable barrier operator system component, the movable barrier operator system component being remote from the moveable barrier operator and which component transmits signals to the moveable barrier operator and the moveable barrier operator being configured to receive the signals from the component;

programming the control surface to provide a first operational parameter to illustrate the first operational parameter on a liquid crystal display integral to the movable barrier operator system component at a first time, the liquid crystal display selected from the group consisting of an alphanumeric display, a graphics display and combinations thereof;

programming the control surface to provide a second operational parameter and to illustrate the second operational parameter on the display at a second time;

wherein the user input initiates the transmission of the signals from the operational component directly to the barrier operator with the user-assertable control.

28. The method of claim 27 wherein the first operational parameter comprises a system setting to adjust and the second operational parameter comprises changing the magnitude of the system setting.

29. The method of claim 28 wherein the system setting is selected from the group consisting of a force setting and a time setting.

30. The method of claim 27 wherein at least a portion of the display comprises a touch-screen display.

31. An apparatus comprising:

a movable barrier operator system operational component which is remote from a moveable barrier operator and which component transmits commands to the moveable barrier operator and the moveable barrier operator is configured to receive the commands from the component;

a liquid crystal display that is integral to the movable barrier operator system component, the liquid crystal display selected from the group consisting of an alphanumeric display, a graphics display and combinations thereof;

at least one user assertable control surface associated with the liquid crystal display and configured for actuation by a user to indicate at least one command to effect an operational parameter selected from the group consisting of an operating feature, a system setting which configures the operation of a moveable barrier operator and combinations thereof;

a transmitter coupled to the at least one user assertable control surface and arranged to send the command received at the at least one user assertable control surface to the moveable barrier operator via a communication link, wherein actuation of the at least one user assertable control surface by the user initiates the transmission of the command from the operational component directly to the moveable barrier operator to effect changes in the operational parameters stored in the moveable barrier operator via the communication link.

32. The apparatus of claim 31 wherein the movable barrier operator system operational component comprises a device selected from a group consisting of a movable barrier operator remote control device and a wall mounted device.

33. The apparatus of claim 32 wherein the movable barrier operator remote control device comprises a wireless movable barrier operator remote control device.

34. The apparatus of claim 33 wherein the wireless movable barrier operator remote control device comprises at least one of:

an infrared-based wireless movable barrier operator remote control device;

a radio frequency-based wireless movable barrier operator remote control device;

an optical signal-based wireless movable barrier operator remote control device;

a sound based-wireless movable barrier operator remote control device.

35. The apparatus of claim 32 wherein the movable barrier operator remote control device is physically coupled to the movable barrier operator.

36. The apparatus of claim 35 wherein the movable barrier operator remote control device is physically coupled to the movable barrier operator by at least one of:

an electrical conductor-based signal path;

an optical-based signal path.

37. The apparatus of claim 31 and further comprising a housing that houses at least a substantially part of the movable barrier operator system operational component and that at least partially supports the display.

38. The apparatus of claim 31 wherein at least a portion of the display comprises a touch-screen display.

39. The apparatus of claim 38 wherein all of the display comprises a touch-screen display.

40. The apparatus of claim 31 wherein the at least one user-assertable control surface is disposed proximal to the display.

41. The apparatus of claim 40 and further comprising a plurality of the user-assertable control surfaces.

42. The apparatus of claim 31 wherein the movable barrier operator system operational component further comprises:

at least one fixed-function user-assertable control surface.

43. The apparatus of claim 31 wherein the movable barrier operator system operational component further comprises at least one user-input interface.

44. The apparatus of claim 43 wherein the at least one user-input interface comprises at least one of: a user-assertable control surface; and an audio interface.

45. The apparatus of claim 44 wherein the audio interface comprises a speech recognition-based interface to receive an audio input from the user.

46. The apparatus of claim 31 and further comprising a second display that is operably coupled to the movable barrier operator system operational component.

47. The apparatus of claim 46 wherein the second display is disposed distal to the movable barrier operator system operational component.

48. The apparatus of claim 31 wherein the display comprises a monochromatic display.

49. The apparatus of claim 31 wherein the display comprises a multi-color display.

50. The apparatus of claim 31 wherein the movable barrier operator system operational component operably couples to the movable barrier operator.

51. The apparatus of claim 50 wherein the movable barrier operator system operational component operably couples via a 2-wire conductor to the movable barrier operator.

52. The apparatus of claim 51 wherein the movable barrier operator system operational component operably couples via a 2-wire conductor serial data bus to the movable barrier operator.

53. The apparatus of claim 50 wherein the movable barrier operator system operational component operably couples to a plurality of movable barrier operators.

54. The apparatus of claim 53 wherein the movable barrier operator system operational component operably couples via a serial bus to a plurality of movable barrier operators.

55. The apparatus of claim 53 wherein the movable barrier operator system operational component operably couples in parallel to a plurality of movable barrier operators.

56. The apparatus of claim 31 wherein at least a portion of the display comprises a touch-screen display.

57. A moveable barrier operator system comprising a moveable barrier control system, the moveable barrier control system including a movable barrier control system component which is at least partially remote from a moveable barrier operator and configured to transmit signals to the moveable barrier operator and the moveable barrier operator is configured to receive the signals from the component, the component being operably coupled to a liquid crystal display which includes a display selected from the group consisting of an alphanumeric display, a graphics display and combinations thereof, the liquid crystal display configured to display at least one operational parameter stored on the moveable barrier control system, the at least one operational parameter selected from the group consisting of an operating feature, a system setting which configures the operation of the moveable barrier operator and combinations thereof;

wherein the movable barrier control system component comprises one of a portion of a movable barrier operator or a remote control user interface in responsive communication with the movable barrier operator such that the movable barrier control system component is configured to effect the at least one operational parameter stored on the moveable barrier control system;

wherein the liquid crystal display is operably coupled to the movable barrier control system component to be actively responsive to communications received from the movable barrier operator to produce an informational content on the liquid crystal display related to the operational parameter, the liquid crystal display configured to change the operational parameter represented on the liquid crystal display and stored on the moveable barrier control system according to received user input at the movable barrier control system component that is transmitted from the movable barrier control system component directly to the moveable barrier operator.

58. The system of claim 57 wherein the system setting comprises a state associated with operations of the movable barrier control system.

59. The system of claim 57 wherein the system setting comprises at least one selected from the group consisting of:

present maximum force settings;

availability of electrical power;

operational linkage between the movable barrier operator and one or more remote interfaces;

vacation mode settings;

confirmation of calibration actions operational status information;

calculated battery life expectancy;

authentication data;

communications statistics; and information regarding the automated movable barrier control system component.

60. The system of claim 57 wherein the display is further configured to display an operational setting of the movable barrier control system, the operational setting indicating a state associated with a present operation of the movable barrier control system.

61. The system of claim 60 wherein the operational setting comprises at least one selected from the group consisting of:

speed of movement of the barrier;

motor temperature;

confirmation of calibration actions;

measured values;

a warning regarding at least one of an obstacle in a path of a movable barrier, excessive motor temperature, excessive applied force, excessive movable barrier speed of movement, and unauthorized movement of a movable barrier, information regarding an operating condition;

information that explains a given action of the automated movable barrier control system;

information regarding the automated movable barrier control system component;

information comprising a warning regarding the automated movable barrier control system;

information regarding installation instructions;

information regarding set-up instructions;

information regarding usage instruction;

information regarding configuration information;

information regarding maintenance information;

information regarding safe-operation information.

62. The system of claim 57 wherein at least a portion of the display device comprises a touch-screen display.

63. A method comprising:

displaying configuration command options relating to at least one operational parameter stored in a movable barrier operator system on a liquid crystal display that is integral to a movable barrier operator system component, the movable barrier operator system component being remote from a moveable barrier operator and which component transmits signals to the moveable barrier operator and the moveable barrier operator is configured to receive the signals from the component, the liquid crystal display selected from the group consisting of an alphanumeric display, a graphics display and combinations thereof, and the operational parameter selected from the group consisting of an operating feature, a system setting which configures the operation of a moveable barrier operator and combinations thereof;

receiving a user input effective of the at least one via actuation of at least one user assertable control surface associated with the liquid crystal display;

sending the user input received at the at least one user assertable control surface from the component directly to the moveable barrier operator to adjust the at least one operational parameter stored in the moveable barrier operator.

64. The method of claim 63 wherein the system setting comprises at least one selected from the group consisting of:

present maximum force settings;

availability of electrical power;

operational linkage between the movable barrier operator and one or more remote interfaces;

vacation mode settings;

confirmation of calibration actions;

operational status information;

calculated battery life expectancy;

authentication data;

communications statistics; and information regarding the automated movable barrier control system component.

65. The method of claim 63 wherein at least a portion of the display comprises a touch-screen display.

* * * * *

UNITED STATES PATENT AND TRADEMARK OFFICE

CERTIFICATE OF CORRECTION

PATENT NO. : 7,750,890 B2
APPLICATION NO. : 10/843222
DATED : July 6, 2010
INVENTOR(S) : James J. Fitzgibbon et al.

It is certified that error appears in the above-identified patent and that said Letters Patent is hereby corrected as shown below:

IN THE CLAIMS:

Column 13, Claim 59, Line 44; Change “actions” to -- actions; --.

Column 14, Claim 61, Line 14; Change “instruction;” to -- instructions; --.

Signed and Sealed this
Thirtieth Day of August, 2011

David J. Kappos

David J. Kappos
*Director of the United States Patent and Trademark Office*